US008181582B2

(12) United States Patent
Abel et al.

(10) Patent No.: US 8,181,582 B2
(45) **Date of Patent: *May 22, 2012**

(54) PORTABLE, MODULAR VOTING BOOTH

(75) Inventors: Gary V. Abel, Ellicott City, MD (US); Joseph Wilson, Spencer, WV (US)

(73) Assignees: C.R. Daniels, Inc., Ellicott City, MD (US); Casto & Harris, Inc., Spencer, WV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/020,295

(22) Filed: Feb. 3, 2011

(65) Prior Publication Data

US 2011/0219991 A1 Sep. 15, 2011

Related U.S. Application Data

(62) Division of application No. 12/719,996, filed on Mar. 9, 2010, now Pat. No. 7,895,954.

(51) Int. Cl.
*A47B 7/02* (2006.01)

(52) U.S. Cl. ..... 108/91

(58) Field of Classification Search ..... 108/91, 108/1; 312/196; 297/239, 448.1; 211/188, 211/126.7; 235/386, 51, 50 B, 54 A, 54 F, 235/55 A, 55 E; 280/33.998, 33.991, 47.4, 280/87.021, 47.35

See application file for complete search history.

(56) References Cited

U.S. PATENT DOCUMENTS

| | | | | | |
|---|---|---|---|---|---|
| 1,941,340 | A | * | 12/1933 | Louis Dellert | 297/239 |
| 2,762,669 | A | * | 9/1956 | Watson | 108/91 |
| 2,794,695 | A | * | 6/1957 | Heal | 108/146 |
| 2,992,833 | A | * | 7/1961 | Hoedinghaus et al. | 280/641 |
| 3,351,402 | A | * | 11/1967 | Barecki et al. | 312/233 |
| 3,629,960 | A | * | 12/1971 | Roush | 434/429 |
| 4,067,606 | A | * | 1/1978 | Desmoulins nee Fouchereau et al. | 297/141 |
| D273,337 | S | * | 4/1984 | Semerjian et al. | D34/21 |
| 4,445,731 | A | | 5/1984 | Ahmann | |
| 4,484,787 | A | | 11/1984 | Stephens | |
| 4,529,246 | A | * | 7/1985 | Leib | 297/285 |
| 5,613,448 | A | | 3/1997 | Petty | |
| 6,827,262 | B2 | | 12/2004 | McClure et al. | |

* cited by examiner

*Primary Examiner* — Janet M Wilkens
(74) *Attorney, Agent, or Firm* — Ober, Kaler, Grimes & Shriver; Royal W. Craig

(57) ABSTRACT

A voting booth that is easily transported between a polling-facility and a storage facility and is efficiently stored with other voting booths when not in use. The voting booth comprises a working surface, privacy panels, and a leg assembly. The leg assembly includes a plurality of casters. The voting booth components are configured to allow modular grouping and nesting with voting booths of like construction. The voting booth is light-weight and has a high degree of mobility. The nesting ability provides for efficient storage by minimizing the space needed to store multiple voting booths.

23 Claims, 8 Drawing Sheets

PORTABLE, MODULAR VOTING BOOTH

CROSS-REFERENCE TO RELATED APPLICATION

The present application is a division of 12/719,996, filed Mar. 9, 2010, now U.S. Pat. No. 7,895,954 issued Mar. 1, 2011, which is incorporated herein by reference.

BACKGROUND OF THE INVENTION

1. Field of the Invention

The present invention relates to voting booths and, in particular, to portable, modular voting booths that can be easily nested, grouped, stored, and transported.

2. Description of the Background

Voting is one of the most fundamental acts of a democratic society, and the privacy of the voters is paramount for several reasons. First of all, privacy avoids post -election partiality by the winning government. Secondly, privacy ensures that voters are not influenced by the popular vote. For these reasons there are laws to ensure voter privacy, and voting booths to comply with these laws.

A voting booth provides an individual voter with an enclosed area for casting a vote, using a ballot, mechanical, or electronic voting system, at a polling-place facility. This ensures voter anonymity. Voting booths can be permanent against-the-wall enclosures each having a door or curtain. However, given the infrequent nature of elections polling places are seldom single purpose facilities. Most polling-places are temporary facilities—often times schools, halls, and local government offices—that are used for voting on a temporary basis because elections only occur periodically over a short time period. Permanent voting booth installations are not possible in this case, and instead it is necessary to store and transport multiple voting booths between a storage location (during non-election periods) and the polling -place (during elections). Consequently, voting booths are typically free-standing temporary structures having a working surface and privacy panels that obstruct the view of others in the vicinity.

During elections, a polling place will have multiple voting booths to accommodate numerous voters simultaneously. It is a daunting task for local election officials to transport hundreds of voting booths and other voting equipment to their facility every four years, and to deploy them all. Thus, voting booths must be versatile, combining rugged durability with functionality in a self-contained and lightweight form factor. Indeed, modern voting booths must be strong enough to support heavy voting machines. Therefore, any design that makes storage more compact and transport easier without sacrificing durability would be greatly advantageous. There have been previous efforts in this regard.

For example, U.S. Pat. No. 6,827,262 to McClure et al shows a portable voting booth that can be placed into a closed position for storage within a case. The reference has an inclined working surface (FIG. 1; col. 3,11. 40-44); a leg assembly coupled to the working surface (FIG. 1; col. 3,11. 40-43); and a plurality of side panels (FIG. 1.; col. 2,11. 62-65). The reference is designed as a knock-down device which compromises durability.

Petty, U.S. Pat. No. 5,613,448, discloses a nesting desk with a trapezoidal, inclined working surface (FIG. 1; col. 2,1. 2; col. 2,11. 19-26) and a trapezoidal leg assembly fixedly attached to the working surface (FIG. 1; col. 2,11. 16-19; col. 2,11. 50-51). However, the reference is not a portable voting booth and does not disclose privacy panels or a wheeled leg assembly.

Stephens, U.S. Pat. No. 4,484,787, relates to a disposable foldable combination voting booth and speaker's lectern. The reference discloses a working surface (col. 3,11. 22-25); a plurality of panels extending upward from the left, back, and right sides of a working surface (FIG. 2; col. 3,11. 26-29); and a leg assembly (FIG. 1; col. 3,11. 36-38). The reference does not disclose any degree of durability or nestability.

Houston, U.S. Pat. No. 4,484,755, relates to a cart having a basket and wheeled metal chassis that is adapted for use by handicapped persons. The reference discloses a trapezoidal leg assembly having a plurality of casters mounted underneath (FIG. 4; col. 5,11. 53-55; col. 5,11. 33-36). The reference is not a voting booth and does not disclose any privacy or nestability.

Fouchereau et al., U.S. Pat. No. 4,067,606, relates to a trolley table having a folding seat. The reference discloses an inclined working surface (FIGS. 2, 5; col. 3,11. 25-30; col. 3,11. 58-60), a trapezoidal leg assembly fixedly attached to the working surface and with a plurality of casters mounted underneath (FIGS. 1, 3; col. 3,11. 3-7; col. 3,11. 62-64; col. 3,11. 6-7). The reference is not a voting booth and does not disclose any privacy or nestability.

Ahmann, U.S. Pat. No. 4,445,731 relates to a collapsible voting booth. The reference discloses an horizontal working surface (FIG. 2, col. 4, 11. 30-40), four outwardly-inclined legs fixedly attached to the working surface (FIG. 2, col. 3,11. 1-17). The reference also discloses a plurality of privacy panels (FIG. 2, col. 3,11. 25-37), but no casters mounted underneath. Again, the reference is designed as a knock-down device which compromises durability.

In this regard there is a need for a voting booth that is portable, has a high degree mobility, and is lightweight. There is also a need for a nesting voting booth that allows many such booths to be stacked and transported, thereby minimizing storage space and effort.

SUMMARY OF THE INVENTION

According to the embodiments of the present invention, a portable, modular voting booth is provided that has the capability of nesting with other voting booths for compact storage, transport there from in a wheeled group, and easy deployment. The voting booth is easily transported between a polling-place facility and a storage facility, and is efficiently stored with other voting booths when not in use. The voting booth is a free-standing structure, comprising a working surface surrounded by privacy panels atop a freestanding leg assembly. The working surface is a thin, flat platform surface having an elongate front-edge, and side edges defining a geometric shape that is fully open to the front edge. The working surface is upwardly inclined from front edge to back. During voting use, the working surface supports a paper ballot or electronic voting machine waist-high in front of the voter, supported by the leg assembly. The leg assembly is constructed of structural framework of struts connected in a continuous curvilinear or angled frame, which includes a horizontal wheeled floor base defined as a geometric shape that is fully open at and to the front. The leg assembly also includes at least one elongate leg and preferably two legs fixedly attached at one end to the wheeled floor base, extending upward to the working surface, and joined thereto to support the working surface at approximately waist level and at said slight incline relative to the floor base. The leg assembly provides good stability, and yet slight resiliency, to facilitate nesting of multiple booths and high-density stacking thereof. The height of the working surface and the width between the elongate legs may be adjusted to accommodate voters in wheel chairs. The floor base is wheeled by virtue of a plurality of casters attached beneath the floor base for increased mobility. Extending upward from the working surface are privacy panels that obstruct the view of others, thus providing voter privacy.

An exemplary embodiment of the voting booth is described herein in which the geometric shape of both the working surface and the floor base is trapezoidal, the leg assembly, working surface, and privacy panels conforming thereto. The trapezoidal shape allows the voting booth to be easily positioned into a straight-line or arcuate modular grouping with other booths for efficient use of polling-place facility space and for maximum voter privacy and comfort. Additionally, the trapezoidal shape in combination with the inclined working surface allows for nesting engagement of a voting booth with voting booths of like construction—the back-side of a voting booth can be inserted into the front of another voting booth for a close engagement—which allows for efficient storage or transport of multiple booths at one time. The voting booth's scale can be changed to accommodate any voting system, including ballot, mechanical, and electronic systems. To increase mobility, the voting booth is structurally designed to minimize weight.

BRIEF DESCRIPTION OF THE DRAWINGS

Other objects, features, and advantages of the present invention will become more apparent from the following detailed description of the preferred embodiment and certain modifications thereof, in which.

DETAILED DESCRIPTION

Figure 1:
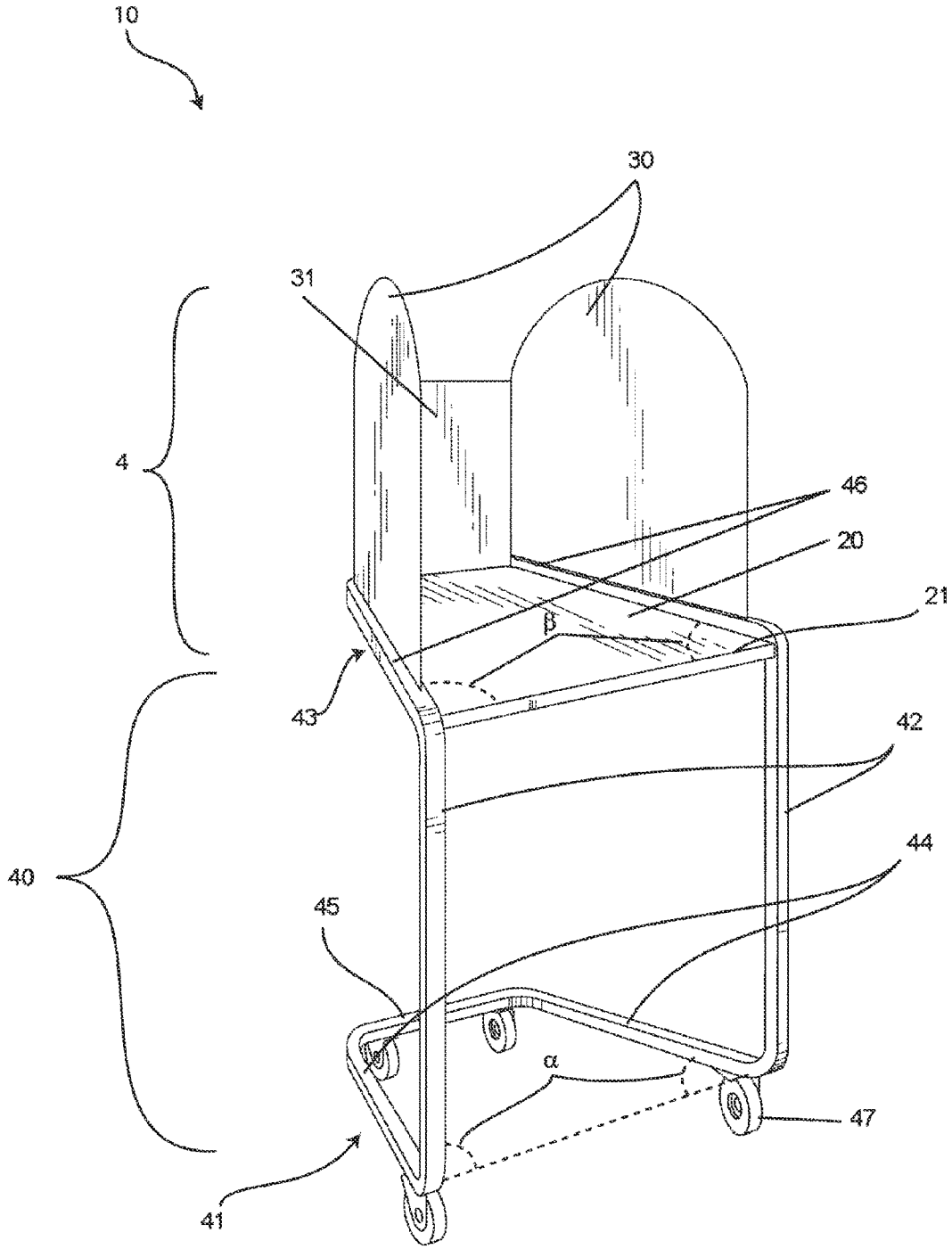
FIG. 1 is a perspective view of a portable, modular voting booth according to an embodiment of the present invention.
Figure 2:
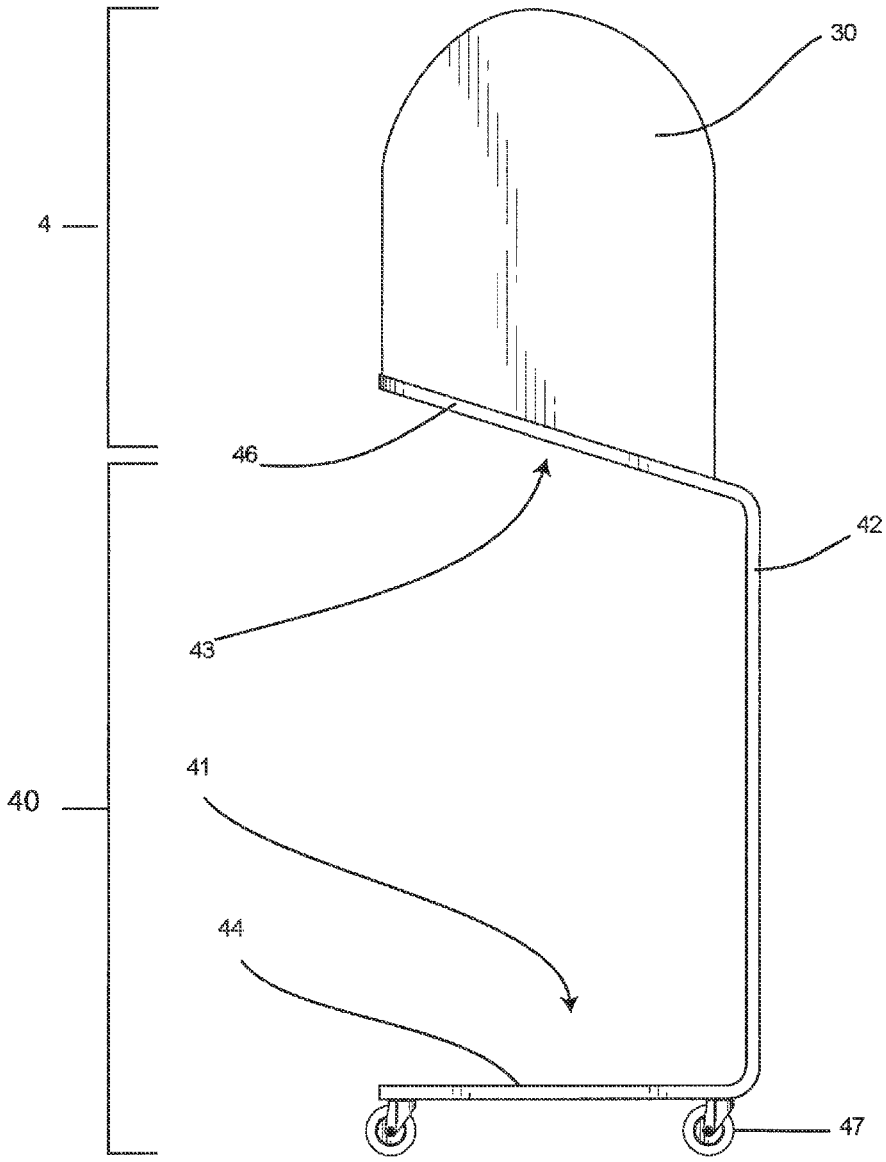
FIG. 2 is a side view of the voting booth as in FIG. 1.
Figure 3:
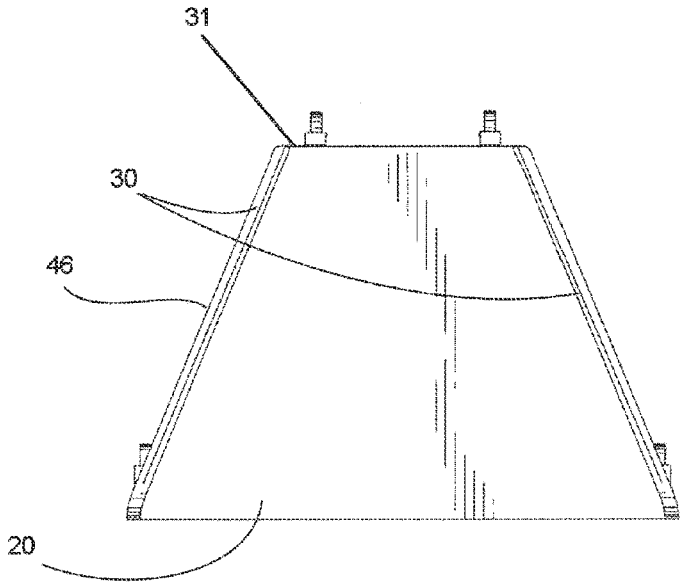
FIG. 3 is a top view of the voting booth as in FIGS. 1-3.
Figure 4:
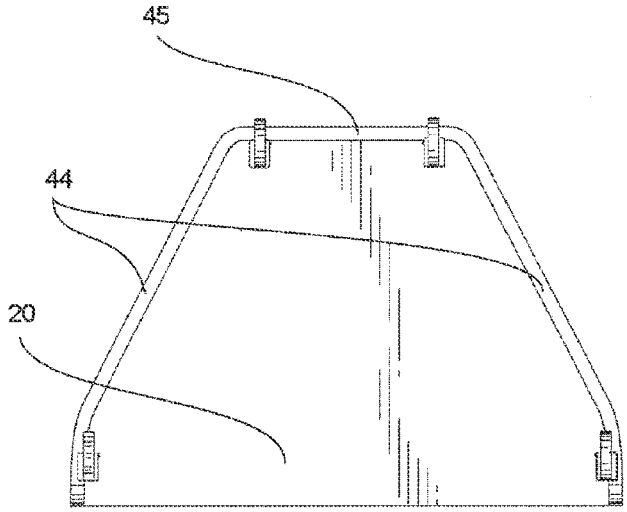
FIG. 4 is a bottom view of the voting booth as in FIGS. 1-4.
Figure 5:
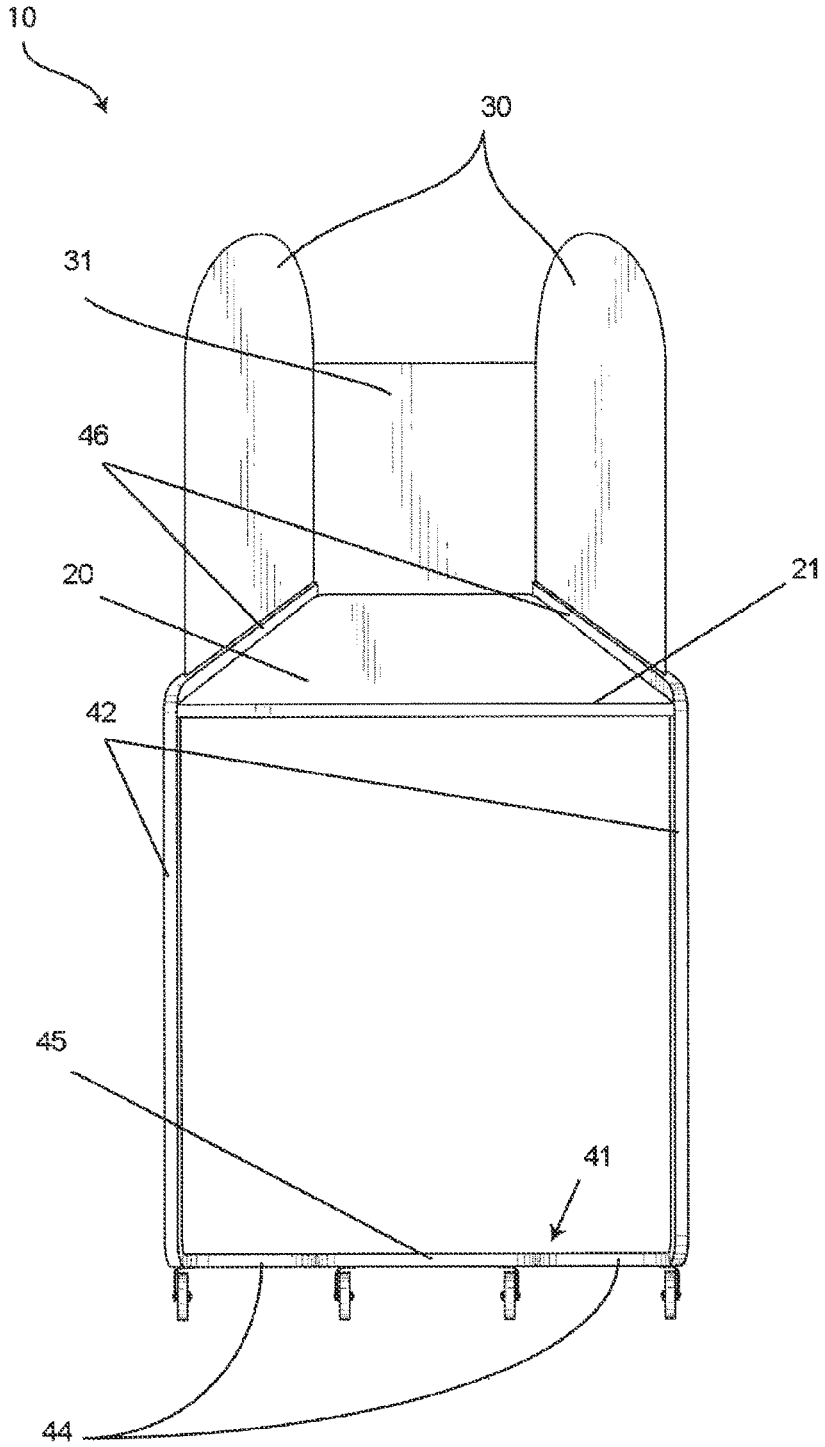
FIG. 5 is a front view of the voting booth as in FIGS. 1-5.
Figure 6:
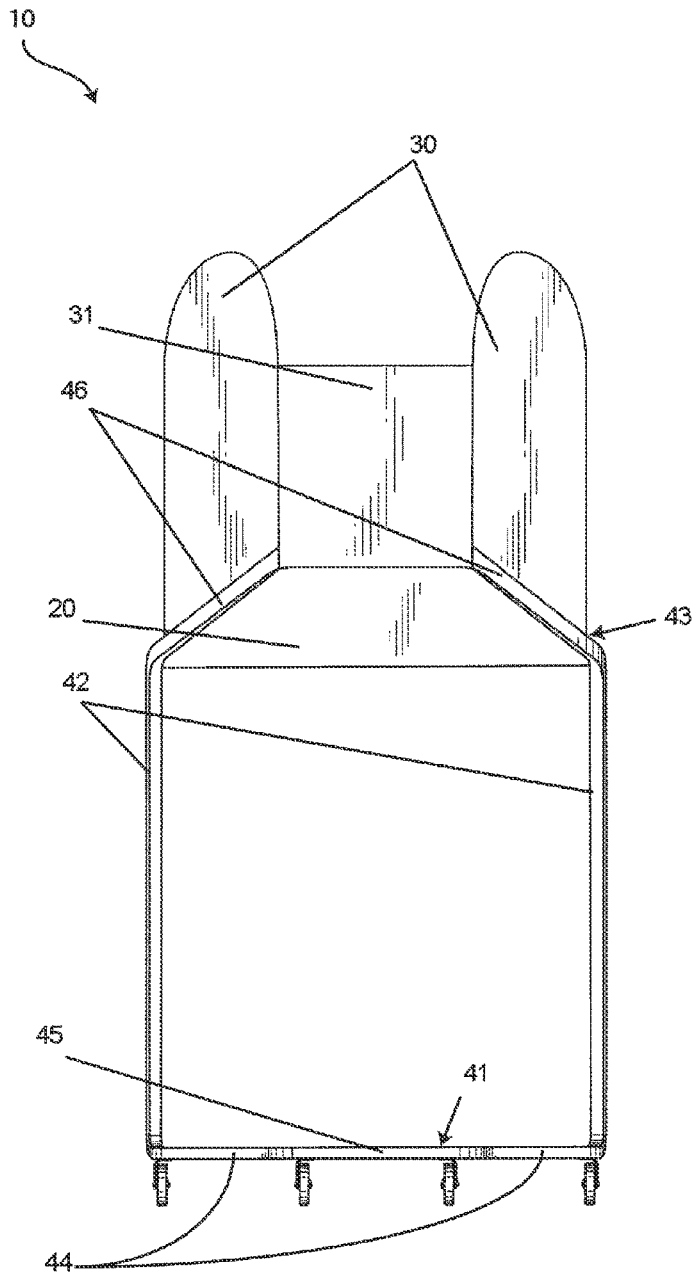
FIG. 6 is a back view of the voting booth as in FIGS. 1-6.

FIG. 1 is a perspective view of a portable, modular voting booth according to an embodiment of the present invention. The voting booth 10 is a free-standing structure that is easily transported between a polling-facility and a storage facility and is efficiently stored with other voting booths when not in use. The voting booth 10 generally comprises an elevated semi-enclosure 4 atop a freestanding leg assembly 40 in a rigid (non-collapsing) yet compliant (shock-absorbing) configuration. The semi-enclosure 4 sits atop the leg assembly 40 and forms an open-topped, open-faced space bounded by a downwardly sloping working surface 20, a rear panel 31, and opposing outwardly-flared privacy panels 30. The leg assembly 40 is formed of a continuous curvilinear or angled framework of supporting struts, preferably rod-like members, and even more preferably square ¾-1" steel tube stock. The leg assembly 40 has a top platform support section formed to define a near-horizontal but downward sloping isosceles trapezoid supporting the semi-enclosure 4. The trapezoidal top section of leg assembly 40 is bounded by three conjoined lengths including a short rear length (obscured in FIG. 1) adjacent the conjoined lower edge of the rear panel 31 and back edge of the working surface 20, and two longer outwardly flared and downwardly-sloping side lengths 46 adjacent each of the conjoined lower edges of the privacy panels 30 and side edges of the working surface 20.

More specifically, and with collective reference to FIGS. 1-7, in the illustrated embodiment the working surface 20 is a thin, flat platform surface having an elongate front-edge, and side edges defining a geometric shape that is fully open to the front edge (meaning any semicircular, arcuate or polygonal shape bounded on one side by the front edge, having side edges that intersect the front edge at an acute angle less than 90 degrees, and which run semicircular, arcuate or polygonal from corner to corner in a fully open configuration to allow unencumbered nesting. In the illustrated embodiment the working surface 20 is polygonal (specifically isosceles trapezoid with the front edge forming the major base) and affixed atop leg assembly 40 so as to be upwardly inclined from front edge to back. The working surface can be any shape provided the two adjacent interior angles of intersection with the front edge are less than 90 degrees to allow for nesting. An isosceles trapezoid (as shown) is presently preferred. However, other suitable shapes may include semicircles, other trapezoids and/or equilateral triangles. The working surface 20 may comprise any suitable rigid material, for example, steel or aluminum sheeting or plating, plastic, composite material, or laminated wood or particle board. For aesthetics, durability and weight, coated (painted) steel sheet is preferred with downwardly-angled edges butt-welded at the corners to increases rigidity. The working surface 20 is inclined on one hand to provide an ergonomically sloped writing surface, and also to facilitate nesting (as will be described). The working surface 20 is appropriately sized to accommodate a range of conventional balloting systems—including electronic ballot machines or other electronic systems. Preferably, the working surface 20 will accommodate a twenty inch ballot in both landscape and portrait positions. If a machine or electronic voting system is being used, an attachment mechanism may be attached to the working surface 20 to secure the voting device. For example, such attachment mechanisms may include straps, brackets, fasteners, adhesives, etc. Preferably, the foremost edge of the working surface 20 is bent upward then downward to create a protruding upward flange 21. Flange 21 prevents articles from sliding off the working surface and also increases strength to prevent buckling. The downwardly-angled edges of working surface 20 at the rear and sides may be attached by metal screws to the side and rear lengths of the top platform support section of leg assembly 40, the screws penetrating first through the downwardly-angled edges of working surface 20 and into the leg assembly 40 from beneath the working surface 20 to minimize outward protrusions. The rear panel 31 and opposing outwardly-flared privacy panels 30 are preferably formed of a rigid thin, flat sheet material such as coated (painted) sheet steel, and in the illustrated configuration the rear panel 31 is attached inside the rear length of leg assembly while the privacy panels 30 are welded directly along the top surface of the outwardly flared and downwardly-sloping side lengths 46 of leg assembly 40. The rear panel 31 may be formed separately from the opposing outwardly-flared privacy panels 30 and attached thereto by welding or the like, or alternatively, the rear panel 31 and opposing outwardly-flared privacy panels 30 may be formed from a single-patterned sheet of steel and bent into the illustrated configuration.

The leg assembly 40 further includes a floor base section 41, and two opposing vertical legs 42 joining the base section 41 to the top platform support section 43. The floor base 41 comprises a horizontal wheeled base formed of a single or multiple conjoined struts bent or connected in a curvilinear or angled manner to define as a geometric shape that is fully open at and to the front. The floor base 41 is bounded along all sides and back, but is fully open frontally. Like the working surface 20, the floor base 41 partially circumscribes any semi-circular, arcuate or polygonal geometric shape, but is fully open at the front to allow unencumbered nesting. In the illustrated embodiment, the floor base 41 is defined by three conjoined lengths, including opposing side lengths 44 and rear length 45, substantially identical to the top platform support section 43 and likewise arrayed in a polygonal configuration that corresponds to the trapezoidal shape of the top platform support section 43 and working surface 20. Thus, in the illustrated embodiment, the bottom-side members 44 and bottom horizontal member 45 are arrayed along the legs and minor base of an isosceles trapezoid. Importantly, the polygonal base section 41 is unbounded at the front to allow for nesting. Instead, the struts of leg assembly are bent upward to form two elongate vertical legs 42 that rise upward to and join with the top platform support section 43.

Figure 7:
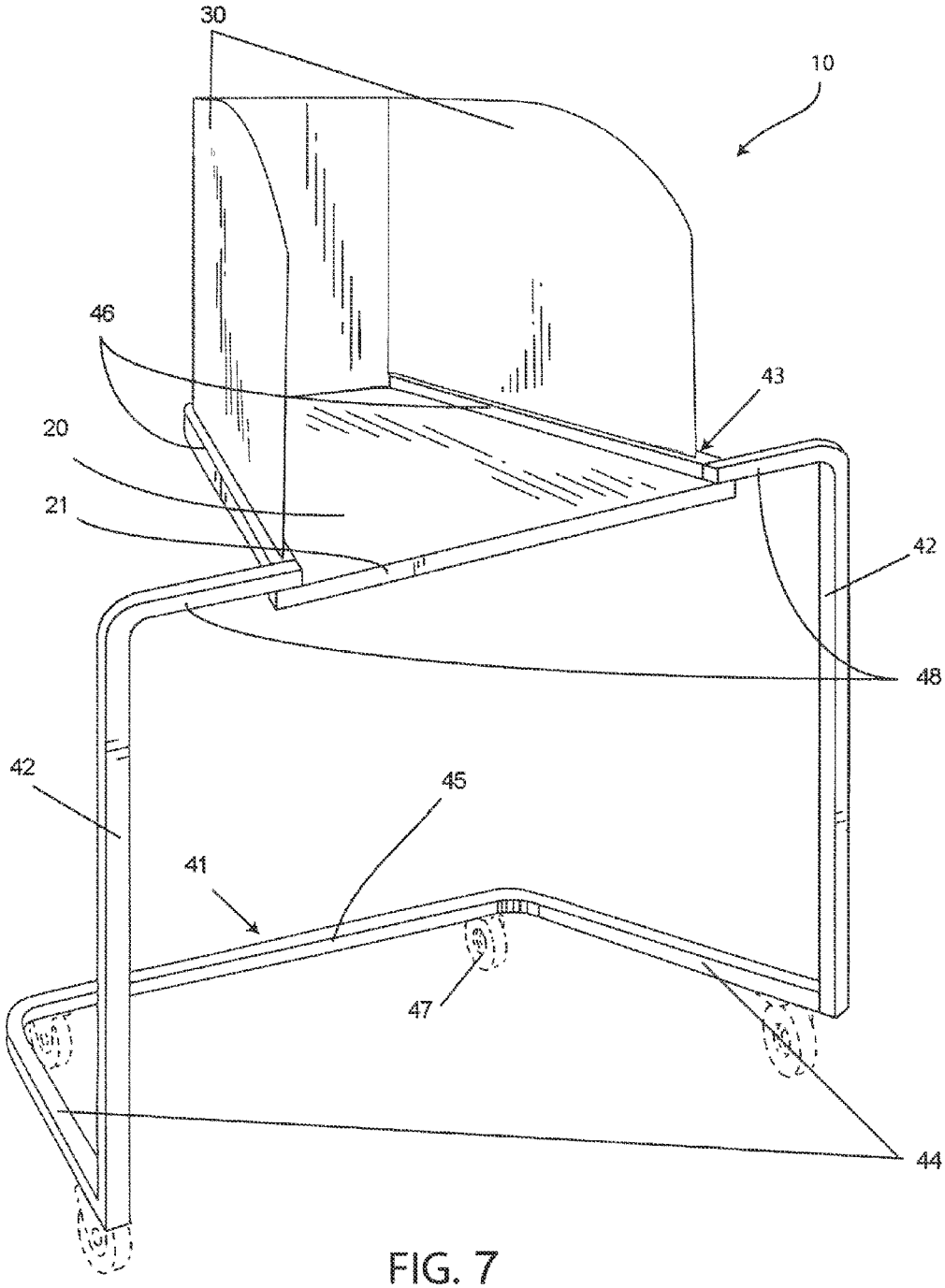
FIG. 7 is a perspective view of a portable, modular voting booth according to an alternative embodiment for use with voters in wheel chairs.

For mobility, a plurality of casters 47 are mounted beneath the leg assembly 40, preferably at all four corners of the trapezoidal base section 41. Bottom-side members 44 are then angled upward and continue along the vertical legs 42. In the preferred embodiment, the vertical legs 42 have a length that positions the working surface 20 at approximately waist-height for a six-foot person—a height that is most convenient to a standing voter. In alternative embodiments, the vertical legs 42 may either be telescoping and equipped with a detent-pin interlock so that the height may be adjusted to accommodate voters in wheel chairs, or as illustrated in FIG. 7, be of a fixed shorter length to accommodate voters in wheel chairs. In the embodiment illustrated in FIG. 7, the floor base 41 is arrayed in a broader polygonal configuration (wider than the polygonal shape of the top platform support section 43 and working surface 20). This allows an increase in the width between vertical legs 42 to accommodate a wheel chair. This also requires an additional angle in the leg assembly, to interspace a pair of horizontal extensions 48 between the vertical legs 42 and the top side members 46, and lengthening of the bottom horizontal member 45. In all the foregoing cases, the length of legs 42 imparts some resiliency to the semi-enclosure 4 and working surface 20. Thus, when one booth 10 is wheeled into another to a nested configuration, the upwardly inclined working surface 20 and inwardly angled privacy panels 30 serve as a ramped receptacle for the similar features of the booth 10 being wheeled, and the slight downward resiliency of the stationery semi-enclosure 4 cooperates with the slight upward resiliency of the moving semi -enclosure 4 to guide nesting, and thereafter impart a pre-bias to maintain the nested configuration during wheeled transport.

To accomplish the foregoing the top platform support section 43 is slightly inclined relative to the floor base 41—the top-side members 46 are inclined upwardly. The angle of incline may range from between 5-45 degrees downward from horizontal, and is preferably about 10 degrees. The top-side members 46 also extend backwards at converging angles equal to those of the bottom-side members 44. The top-side members 46 are fixedly attached to and are adjacent and parallel with the corresponding sides of the working surface 20 and privacy panels 30.

Privacy panels 30 and rear panel 31 extend vertically along the outer periphery of the working surface 20, leaving a voter access to the working surface while also providing voter privacy. The privacy panels 30 and rear panel 31 can be of any height, size, and shape so long as they sufficiently obstruct the view of other standing voters. Preferably privacy panels 30 extend to about shoulder height of a standing 6 foot man (about two feet each in height from the top platform section 43), and the rear panel 31 rises about 1.5 feet from the top platform section 43. The privacy panels 30 and rear panel 31 may extend from the platform support 43 or from the working surface 20. In the illustrated embodiment, privacy panels 30 extend vertically from the top-side members 46 on the left-diagonal, and right-diagonal sides, and the rear panel 31 extends down to the working surface 20 immediately in front of the top rear length of leg assembly 40. The privacy panels may be fixedly attached, for example, by welds or fasteners, to the leg assembly 40 and/or working surface 20. The rear panel 31 is also fixedly attached to the adjacent privacy panels 30, thus acting as a shear wall that resists lateral side-to-side loads placed on the voting booth 10. The combination of the fixed rear panel 31 and the working surface's flange 21 eliminates the need for a horizontal support spanning the privacy panels 30, thus minimizing weight. Although durability is paramount and fixed rigid panels 30, 31 are preferred, one skilled in the art should understand that the privacy panels 30 may alternatively be removably attached or mounted on hinges to provide a knock-down feature to further conserve space when not in use.

The leg assembly 40 may comprise any appropriate elongate structural material including rod-like materials such as tubular stock having a round or square cross-section, and extruded or otherwise formed into one or more rigid elongate struts, and bent or conjoined to the desired shape. Rigid materials such as, for example, square aluminum, steel, composite, or plastic tubing will suffice. Although rod-like or tubular members afford good structural strength, one skilled in the art should understand that elongate flat supporting struts will also suffice. In the presently-preferred embodiment, the leg assembly 40 is formed of 16 gauge structural steel square tubing, and the working surface 20 and privacy panels 30 are formed of 14 gauge steel structural plate. The leg assembly 40 may be formed from one contiguous piece of tubing bent at the desired locations, or the leg assembly 40 may be formed by separate, individual segments fastened or welded together. The tubing is preferably equipped with a baked enamel powder coated finish (nominal 3 mils) with zinc oxide primer wash. The four casters 47 are each 3" swivel stem casters, with optional brake-lock capability.

In the illustrated embodiment, when viewed from above, the voting booth's outer periphery has a trapezoidal shape as the working surface 20 is an isosceles trapezoid, the top -side members 46, bottom-side members 44, and the privacy panels 30 are arrayed along the legs of the isosceles trapezoid, converging from front to back. The resulting open-topped, open-faced polygonal space of the semi-enclosure 4 in combination with the inclined working surface 20 facilitates and indeed encourages nesting. The voting booths can be nested in an upright configuration by wheeling them together, or a voting booth can be laid on its back (on a hand cart) and other voting booths can be dropped therein, beginning with the rear of the second semi -enclosure 4. The polygonal configuration helps to register each successive voter booth and keeps adjacent units in tight nested registration. Moreover, once nested the ¾-1" lengthwise offset between adjacent units allows the leg assemblies 40 to simply be dropped over each other (since they are likewise offset and do not obstruct each other). The front-to-back rod-like configuration of the leg assembly 40 also facilitates nesting since the legs of adjacent units work against the inclined working surface 20 to further lock nested units in position by gravity. This polygonal and preferably trapezoidal periphery and leg assembly 40 provides excellent stability and durability, allows nesting of multiple booths and high-density stacking thereof, gives multiple setup options, and allows for easy transport of multiple voting booths.

Figure 9:
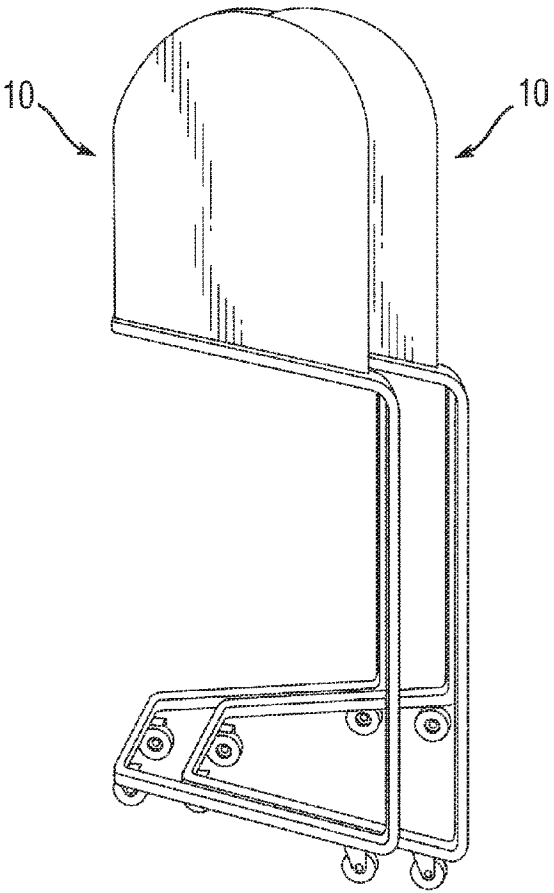
FIG. 9 is a side view of two voting booths nested together.
Figure 8:
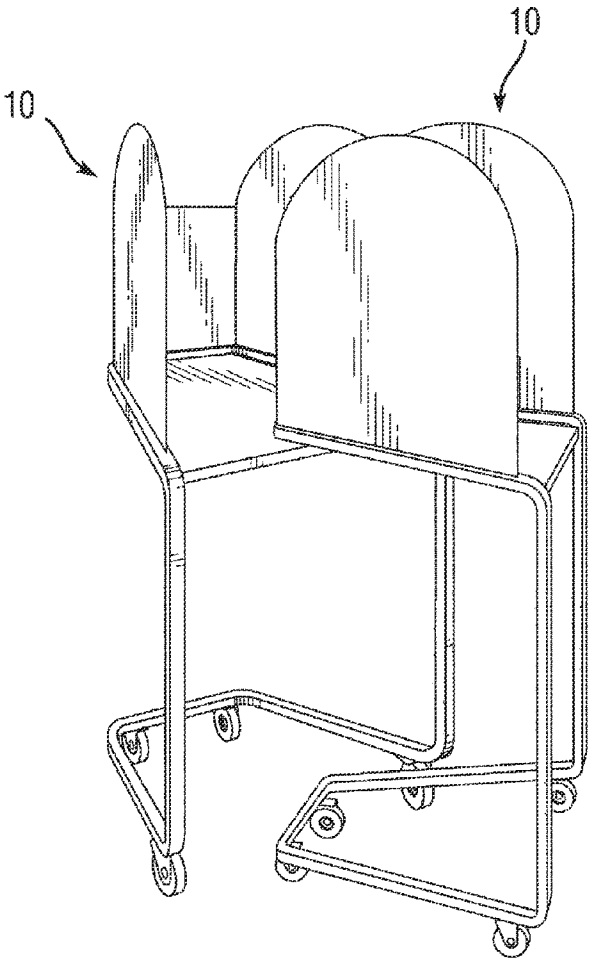
FIG. 8 is a perspective view of two voting booths at an initial stage of being nested.

The ability to nest with other voting booths provides for efficient storage by minimizing the surface area needed for storage. FIGS. 8-9 illustrate the nesting engagement of voting booths 10 according to the present invention. The incline of working surface 20 and the trapezoidal periphery allow unimpeded insertion of the bottom horizontal member 45 and the working surface 20, platform support 43, and back panel of one voting booth between the vertical struts and the side privacy panels of another voting booth. The converging trapezoidal shape also allows another voting booth to be positioned and easily guided into a full nesting position with little precision. Thus, as each booth 10 is wheeled into another into a nested configuration, the respective privacy panels 30 lightly engage and by virtue of their rearward -convergence they center the two booths 10 at the top. Concurrently, the respective bottom-side members 44 lightly engage and by virtue of their rearward convergence they center the two booths 10 at their bottom. In further combination with the upwardly inclined working surface 20 and resiliency of elongate legs 42, the semi-enclosure 4 serves as a ramped receptacle for the booth 10 being wheeled, and the slight downward resiliency of the stationery semi-enclosure 4 cooperates with the slight upward resiliency of the moving semi-enclosure 4 to not only guide nesting, but also to maintain a slight pre-bias thereafter which helps to maintain the nested configuration even during wheeled transport (when an election official is typically pushing on the endmost booth 10 in a long train). Given the overall dimensions of 28" width ×21" length ×60" height of the presently-preferred embodiment, six hundred voting booths can be stored in a 4'×100' area. Each booth occupies a 0.67 square foot area and weighs only 48 lbs. Approximately 83% of the bulk area of each unit is eliminated by nesting.

Figure 11:
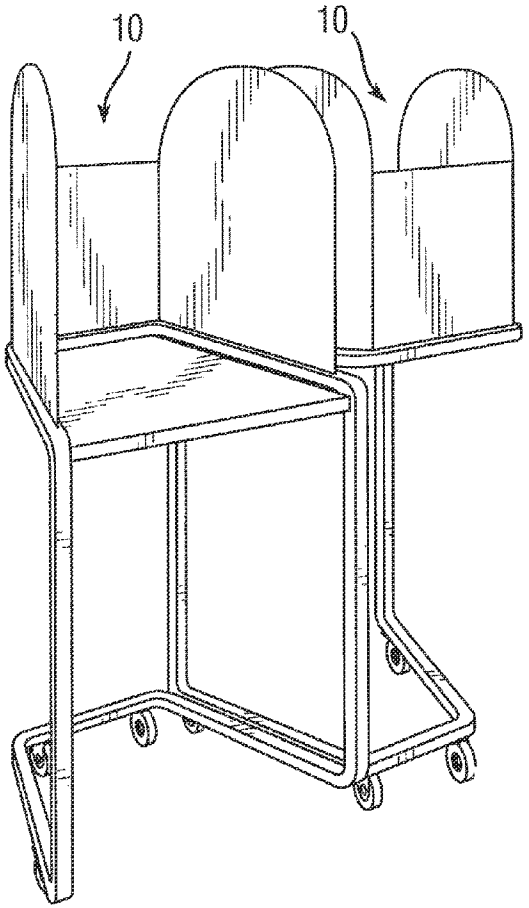
FIG. 11 is a perspective view of an alternating, straight-line modular grouping.
Figure 10:
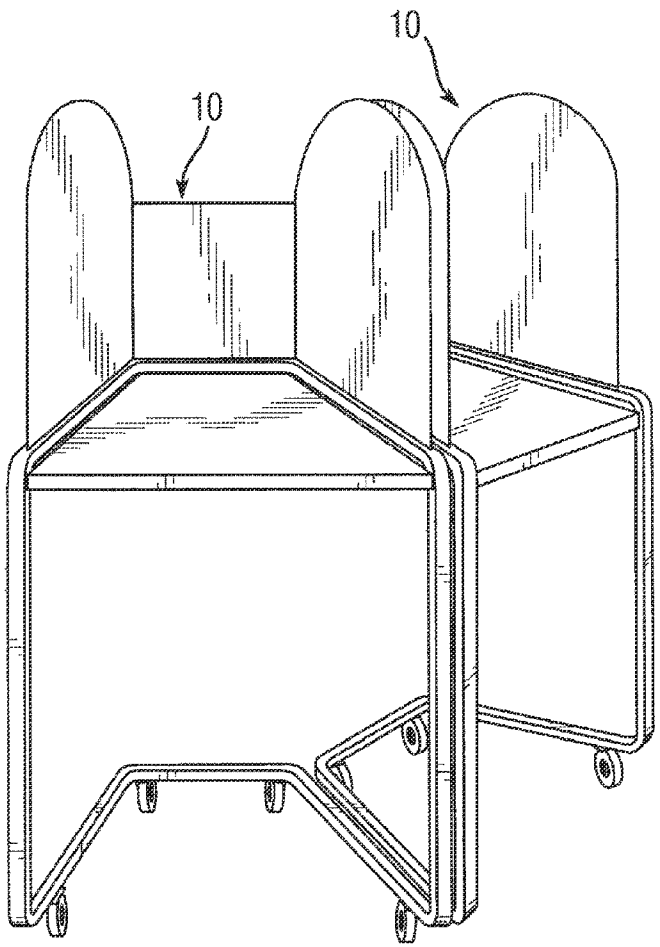
FIG. 10 is a perspective view of an arcuate modular grouping.

The trapezoidal shape also allows similarly constructed voting booths 10 to be positioned in modular groups for use during voting. Modular groupings allow the voting booths to be positioned in a manner that maximizes polling-place facility space during voting, while also maximizing voter privacy and comfort. The trapezoidal shape allows an arcuate modular grouping of outwardly facing voting booths 10, as illustrated in FIG. 10, or a straight-line modular grouping of alternate facing voting booths as illustrated in FIG. 11.

In addition to maximizing storage space and allowing modular groupings, the voting booth nesting ability in combination with the plurality of casters 47 enables transport of multiple voting booths at a time. Multiple voting booths 10 can be nested to together, forming a line of nested booths. And the plurality of casters enables a single person to easily push the entire line of booths.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singularly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A portable, nesting voting booth comprising:

A rigid open-topped, open-faced semi-enclosure bounded along four sides and defined by, a flat, trapezoidal working surface having a pair of front corners and a pair of rear corners, and a peripheral front edge running from front corner-to-corner, a peripheral rear edge running from rear corner-to-corner, and continuous side edges running from rear-corner-to-front-corner and joining said front edge at acute interior angles, such that said front edge defines a major base of said trapezoidal working surface, said working surface being inclined downward to its front edge, and a rear privacy panel rigidly attached along said working surface rear edge and extended substantially vertically therefrom, and a pair of opposing side privacy panels each rigidly attached along a corresponding one of said working surface side edges and extended substantially vertically therefrom; and a structural leg assembly fixedly attached to the working surface, the leg assembly comprising, a horizontal wheeled floor base defined by an elongate support member partially circumscribing a trapezoidal shape along its minor base and sides with opposing side segments diverging to a fully open unbounded front, a plurality of casters mounted beneath said floor base, and pair of elongate support legs each fixedly attached between said floor base and extending to a corresponding front corner of said working surface to suspend said working surface at waist height in said forwardly inclined orientation;

said semi-enclosure being adapted for nesting like semi-enclosures, said leg assembly being adapted for nesting like leg assemblies, and said pair of elongate support legs imparting resilience between said semi-enclosure and floor base to guide and maintain nesting of other voting booths of similar construction.

2. The portable, nesting voting booth according to claim 1, wherein the inclined working surface front edge is linear, said continuous side edges are linear, and said front edge intersects said side edges at effective acute angles.

3. The portable, nesting voting booth according to claim 1, wherein the horizontal wheeled floor base further comprises one or more tubular rod-like members partially circumscribing said trapezoidal shape about its sides and minor base.

4. The portable, nesting voting booth according to claim 3, wherein the one or more tubular rod-like members further comprise a single, unitary rod-like member bent to partially circumscribe said trapezoidal shape.

5. The portable, nesting voting booth according to claim 1, wherein the pair of elongate support legs are each fixedly attached between a corner of said floor base and extend to one of said pair of front corners of said working surface.

6. The portable, nesting voting booth according to claim 5, further comprising a pair of supporting members supporting said working surface and inclined in conformance therewith for attaching the working surface to the pair of elongate support legs.

7. The portable, nesting voting booth according to claim 6, wherein said pair of supporting members are attached along the side edges of said working surface.

8. The portable, nesting voting booth according to claim 1, wherein said working surface is trapezoidal and the pair of opposing side privacy panels and rear privacy panel are removable from said working surface.

9. The portable, nesting voting booth according to claim 1, wherein the leg assembly further comprises four casters mounted underneath proximate each corner of the circumscribed trapezoidal shape.

10. The portable, nesting voting booth according to claim 1, further comprising a supporting member supporting said working surface and inclined in conformance therewith for attaching the working surface to the pair of elongate support legs.

11. A portable, nesting voting booth comprising:

a rigid open-topped, open-faced semi-enclosure bounded along four sides and defined by, a flat, trapezoidal working surface having a front edge, rear edge, and side edges intersecting said front edge at effective acute interior angles, said working surface being inclined downward to its front edge, and a privacy panel bordering said working surface rear edge and side edges and extended substantially vertically therefrom; and a leg assembly fixedly attached to the working surface, the leg assembly comprising, a horizontal wheeled floor base comprising an elongate tubular member partially circumscribing a trapezoidal geometric shape along its minor base and sides with opposing side segments diverging to a fully open unbounded front, a plurality of casters mounted beneath said floor base, and at least one elongate leg fixedly attached between said floor base and said front edge of said working surface to suspend said working surface at waist-height in said forwardly inclined orientation;

said semi-enclosure being adapted for nesting like semi-enclosures, said leg assembly being adapted for nesting like leg assemblies.

12. The portable, nesting voting booth according to claim 11, wherein the inclined working surface front edge is linear, said side edges are linear, and said front edge intersects said side edges at effective acute interior angles.

13. The portable, nesting voting booth according to claim 11, wherein the trapezoidal geometric shape circumscribed by said horizontal wheeled floor base conforms to said trapezoidal working surface and is vertically offset there from.

14. The portable, nesting voting booth according to claim 11, wherein the horizontal wheeled floor base further comprises a unitary tubular member partially circumscribing said trapezoidal geometric shape, terminating at opposing ends and fully frontally open between said ends.

15. The portable, nesting voting booth according to claim 11, wherein the at least one elongate leg further comprises two elongate legs each fixedly attached between said floor base to said working surface.

16. The portable, nesting voting booth according to claim 11, wherein the at least one elongate leg further comprises two elongate legs each fixedly attached between said floor base and extending to a front corner of said working surface.

17. The portable, nesting voting booth according to claim 16, wherein said two elongate legs are each fixedly attached between a respective end of said floor base to a front corner of said working surface.

18. The portable, nesting voting booth according to claim 11, wherein the leg assembly further comprises four casters mounted underneath proximate each corner of the circumscribed trapezoidal shape.

19. The portable, nesting voting booth according to claim 11, wherein the floor base partially circumscribes a trapezoidal shape, and further comprises a single member formed along the non-parallel sides and minor base of said trapezoidal shape.

20. The portable, nesting voting booth according to claim 11, further comprising a supporting member supporting said working surface and inclined in conformance therewith for attaching the working surface to the at least one elongate leg.

21. The portable, nesting voting booth according to claim 20, further comprising a pair of supporting members supporting said working surface and inclined in conformance therewith for attaching the working surface to the at least one elongate leg.

22. The portable, nesting voting booth according to claim 21, wherein said pair of supporting members are attached along the side edges of said working surface.

23. The portable, nesting voting booth according to claim 11, wherein said privacy panel is removable from the rear edge and side edges.

* * * * *